US007557289B2

(12) United States Patent
Tanaka

(10) Patent No.: US 7,557,289 B2
(45) Date of Patent: Jul. 7, 2009

(54) MUSIC DELIVERING APPARATUS AND MUSIC REPRODUCING APPARATUS

(75) Inventor: Katsuaki Tanaka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 271 days.

(21) Appl. No.: 11/290,720

(22) Filed: Nov. 30, 2005

(65) Prior Publication Data

US 2006/0112813 A1 Jun. 1, 2006

(30) Foreign Application Priority Data

Nov. 30, 2004 (JP) ..... 2004-345455

(51) Int. Cl.
*G10H 1/08* (2006.01)

(52) U.S. Cl. ..... 84/625; 381/106

(58) Field of Classification Search ..... 84/625, 84/645

See application file for complete search history.

(56) References Cited

U.S. PATENT DOCUMENTS 6,148,086 A * 11/2000 Ciullo et al. ..... 381/106
7,173,178 B2 * 2/2007 Kobayashi ..... 84/645
2003/0167908 A1 * 9/2003 Nishitani et al. ..... 84/723
2005/0239030 A1 * 10/2005 Hou ..... 434/307 A

FOREIGN PATENT DOCUMENTS

WO WO 01/28204 A1 4/2001
WO WO 02/093873 A1 11/2002

OTHER PUBLICATIONS

Office Action: Republic of China: First Notification of Examination Observations for Patent Application No. 200510126146.1 (Issued: Mar. 7, 2008).

* cited by examiner

*Primary Examiner*—Jeffrey Donels
*Assistant Examiner*—Jianchun Qin
(74) *Attorney, Agent, or Firm*—Pillsbury Winthrop Shaw Pittman LLP

(57) ABSTRACT

A music delivering apparatus includes a storing unit that stores musical data, a sound collecting unit that collects a voice from outside to output audio data, a reading unit that reads the musical data from the storing unit, a mixer that mixes the audio data with the musical data read out by the reading unit to output sound data, a transmitting unit that transmits the sound data to a client, and a volume control unit that lowers volume of the musical data that is read out by the reading unit and supplied to the mixer while the audio data is supplied to the mixer.

4 Claims, 2 Drawing Sheets

MUSIC DELIVERING APPARATUS AND MUSIC REPRODUCING APPARATUS

BACKGROUND OF THE INVENTION

The present invention relates to a music delivering apparatus for delivering music over a network as well as to a music reproducing apparatus.

Various music delivering systems have been provided in which a server as a music delivering apparatus delivers musical content in response to a request from a client as a music reproducing apparatus. A music delivering system disclosed in Non-patent document 1 is one of the music delivering systems of the above kind. In this music delivering system, a user who is in his or her room can send a request to the server through a client and enjoy music that is supplied from the server in response to the request.

[Non-Patent Document 1] YAMAHA MusicCAST (Registered Trademark) Catalogue

Incidentally, among the servers used in the music delivering systems of the above kind is a server which has an external input terminal and can transmit, to a client, an audio signal that is input through the external input terminal. Therefore, if a microphone is connected to the external input terminal of this kind of server, an interphone function that a user's voice on the server side is reproduced on the client side can be realized. However, a problem exists in this connection. That is, if this interphone function is performed while music is being reproduced on the client side, on the client side a user's voice sent from the server is drowned out by the music being reproduced and an interphone conversation cannot be carried on properly.

SUMMARY OF THE INVENTION

The present invention has been made in the above circumstances, and an object of the invention is to provide a music delivering apparatus and a music reproducing apparatus that enable a satisfactory conversation even in a situation that music is being reproduced on the client side.

To attain the above object the invention provides a music delivering apparatus, comprising:

a storing unit that stores musical data;

a sound collecting unit that collects a voice from outside to output audio data;

a reading unit that reads the musical data from the storing unit;

a mixer that mixes the audio data with the musical data read out by the reading unit to output sound data;

a transmitting unit that transmits the sound data to a client; and a volume control unit that lowers volume of the musical data that is read out by the reading unit and supplied to the mixer while the audio data is supplied to the mixer.

In this music delivering apparatus, the volume of musical data is lowered while audio data acquired by the sound collecting unit is mixed with the musical data and sent to a client. Therefore, even while reproducing the musical data, the client can reproduce a voice detected by the sound collecting unit of the music delivering apparatus in such a manner that it is not drowned out by the music being reproduced.

In a preferred embodiment, the music delivering apparatus is provided with reading units, mixers, volume controlling units, and transmitting units capable of operating for respective clients. In this embodiment, when a voice detected by the sound collecting unit is sent to only one or plural particular clients, sets of a reading unit, a mixer, a volume controlling unit, and a transmitting unit operate that correspond to only part of the particular clients that are reproducing musical data.

A volume value to which the volume of musical data should be lowered may be set by a user's manipulating a certain manipulation unit or by calculating it on the basis of an average volume level of audio data acquired by the sound collecting unit and an average volume level of the musical data.

The invention also provides a music reproducing apparatus, comprising:

a communication unit that receives audio data;

a musical data acquiring unit that acquires musical data;

a mixer that mixes the audio data with the musical data to output sound data;

an audio output unit that outputs sound corresponding to the sound data; and a volume control unit that lowers volume of the musical data that is supplied to the mixer while the audio data is supplied to the mixer.

In this aspect of the invention, while the audio output unit outputs a voice corresponding to audio data received from a different apparatus, the volume of the musical data that is acquired by the musical data acquiring unit and supplied to the mixer is lowered. Therefore, a voice corresponding to audio data received from the different apparatus can be reproduced without being drowned out by music being reproduced by the audio output unit.

The music data acquiring unit may be either a device for reading out musical data stored in storing unit or a communication unit for receiving musical data from another apparatus.

The music reproducing apparatus may be provided with a sound collecting unit for receiving a voice from outside the apparatus and outputting audio data and a transmitting unit for transmitting, to another apparatus, the audio data that is output from the sound collecting unit. The music reproducing apparatus may be provided with an informing unit for informing another apparatus of an average volume level of audio data acquired by the sound collecting unit.

In a preferred embodiment, the music reproducing apparatus is informed of an average volume level of audio data received from another apparatus and an average volume level of musical data acquired by the musical data acquiring unit and sets, on the basis of the two average volume levels, a volume level to which the volume of the musical data should lowered by the volume control unit. When audio data are received from plural other apparatus, the music reproducing apparatus is informed of average volume levels of audio data from those apparatus and sets a volume level to which the volume of the musical data should lowered on the basis of a minimum value of the informed average volume levels and an average volume level of musical data acquired by the musical data acquiring unit. In this embodiment, the volume of musical data being reproduced is lowered so as to be suitable for a user uttering a lowest-level voice among the other users involved in a verbal conversation. As such, this embodiment enables an interphone conversation in which each user can hear voices of the other users more easily.

Preferably, the music delivering apparatus further comprises a volume level storage unit that stores an average volume level of the musical data for each tune, and a detecting unit that detects an average volume level of the audio data acquired by the sound collecting unit. The volume control unit lowers the volume of the musical data based on the detected average volume level of the audio data and the average volume level of the musical data that is supplied to the mixer.

Preferably, the music reproducing apparatus, further comprises a detecting unit that detects an average volume level of the audio data acquired by the sound collecting unit, and a transmitting unit that receives an average volume level of the musical data acquired by the musical data acquiring unit. The volume control unit lowers the volume of the musical data based on the detected average volume level of the audio data and the received average volume level of the musical data.

According to the present invention, there is also provided a method of delivering music, comprising:

collecting a voice from outside to output audio data;

reading musical data from a storing unit;

mixing the audio data with the musical data to output sound data;

transmitting the sound data to a client; and lowering volume of the musical data that is read out from the storage unit while the sound data including the audio data is transmitted to the client.

Preferably, the method further comprises:

detecting an average volume level of the audio data; and reading an average volume level of the musical data for each tune from a volume level storage unit, wherein in the lowering process, the volume of the musical data is lowered based on the detected average volume level of the audio data and the average volume level of the musical data.

According to the present invention, there is also provided a method of reproducing a music, comprising:

receiving audio data through a communication unit;

acquiring musical data;

mixing the audio data with the musical data to output sound data;

outputting sound corresponding to the sound data; and lowering volume of the musical data while sound corresponding to the audio data is output Preferably, the method further comprises:

detecting an average volume level of the audio data; and receiving an average volume level of the musical data, wherein in the lowering process, the volume of the musical data is lowered based on the detected average volume level of the audio data and the received average volume level of the musical data.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Embodiments of the present invention will be hereinafter described with reference to the drawings,

Embodiment 1

Figure 1:
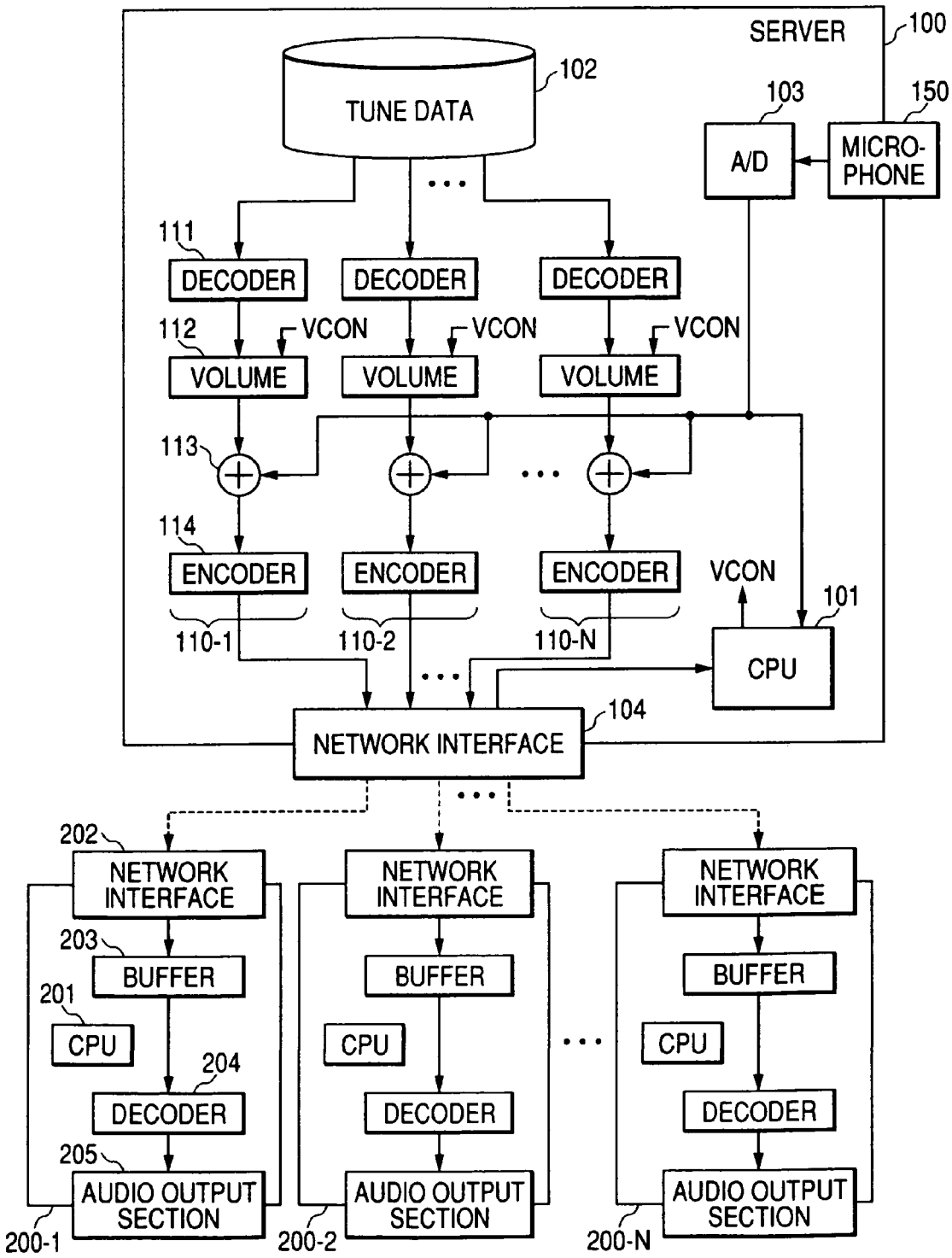
FIG. 1 is a block diagram showing the configuration of a music delivering system according to a first embodiment of the present invention.

FIG. 1 is a block diagram showing the configuration of a music delivering system according to a first embodiment of the invention. As shown in FIG. 1, a server 100 and N clients 200-*k* (k=1 to N) are installed in, for example, different rooms of the same house and the server 100 and each of the N clients 200-*k* are connected to each other via a network such as a home wired or wireless LAN.

The server 100 delivers tune data over the network in response to each client 200-*k*. Tune data is data obtained by compression-coding musical data of a tune. A storage device 102 is an HDD, for example, and a tune data database is stored therein. A microphone 150 is connected to the server 100. The microphone 150, which is provided in a room in which the server 100 is installed, functions as a sound collecting unit for detecting a user's voice in the room. The server 100 and the clients 200-*k* (k=1 to N) include devices for realizing an interphone function of delivering a user's voice detected by the microphone 150 to each of the rooms in which the respective clients 200-*k* (k=1 to N) are installed. A CPU 101, which is a control unit for controlling the individual components of the server 100, performs, as a reading unit, a control for reading tune data from the storage device 102 in response to a request from each of the clients 200-*k* (k=1 to N) and also performs a control for delivering tune data to the clients 200-*k* (k=1 to N) and a control for realizing the interphone function. An A/D converter 103 converts an analog audio signal that is output from the microphone 150 Into digital audio data by sampling the former at a prescribed sampling rate and outputs the digital audio data. A network interface 104 is an interface through which to perform a data communication with each of the clients 200-*k* (k=1 to N) over the network.

The server 100 has N audio transmission processing sections 110-*k* (k=1 to N). Each of the audio transmission processing sections 110-*k* (k=1 to N) has the following configuration. First, a decoder 111 is a device for decoding tune data that is read from the storage device 102 and outputting musical data as sampled data having the same sampling rate as the sampling rate of the A/D converter 103. A volume 112, which is a device that cooperates with the CPU 101 to function as a volume control unit, controls the volume of the musical data that is output from the decoder 111 according to a volume control signal VCON supplied from the CPU 101 and thereby outputs volume-controlled musical data. A mixer 113 is a device for mixing the musical data that is output from the volume 112 with audio data that is output from the A/D converter 103 and outputting resulting sound data. An encoder 114 is a device for compression decoding the sound data that is output from the mixer 113 into data that is in the same form as tune data.

The configuration of each of the clients 200*k* (k=1 to N) is as follows. A CPU 201, which is a control unit for controlling the individual components of the client 200-*k*, acquires sound data (tune data in the case where the interphone function is not performed) from the server 100 and reproduces the acquired sound data according to an instruction that is given by a user by using a remote controller (not shown) or the like. A network interface 202 is an interface through which to perform a data communication with the server 100 over the network. A buffer 203 is a first-in first-out buffer for sequentially storing sound data that are received from the server 100 via the network interface 202 and supplying stored sound data to a decoder 204 in order of storing under the control of the CPU 201. The decoder 204 is a device for decoding the sound data that is output from the buffer 203 into sound data that is the same as before being compression-coded. An audio output section 205 is composed of a D/A converter (not shown) for converting the sound data that is output from the decoder 204 into analog audio signals and speakers (not shown) for outputting the analog audio signals as sound.

Next, the operation of this embodiment will be described. In this embodiment, the usable bandwidth of the network is divided equally into N parts and the N divisional bandwidths are allocated to the N respective clients 200-*k* (k=1 to N). Each of the clients 200-*k* (k=1 to N) sends a tune data delivery request to the server 100 using the bandwidth allocated to it. When receiving a tune data delivery request from a certain client 200-*i* via the network interface 104, the CPU 101 of the server 100 selects one (e.g., an audio transmission processing section 110-*j*), currently not in use, of the audio transmission processing sections 110-*k* (k=1 to N) and causes it to process the tune data to be sent to the client 200-*i*. Under the control of the CPU 101, the tune data requested by the client 200-*i* is read from the storage device 102, processed by the audio transmission processing section 110-*j*, and transmitted to the client 200-*i* via the network interface 104.

In the client 200-*i*, the tune data supplied from the server 100 is received by the network interface 202 and stored in the buffer 203. When a prescribed amount of tune data has been stored in the buffer 203, the CPU 201 instructs the decoder 204 to decode the tune data stored in the buffer 203. In response, the decoder 204 reads out and decodes the tune data stored in the buffer 203 in order of storing and outputs sound data. The sound data is output from the audio output section 205 as sound. In this manner, music is reproduced by the client 200-*i*.

The CPU 201 regularly monitors the residual amount of data stored in the buffer 203, that is, the amount of tune data that have not been read out yet, and informs the server 100 of the residual amount of data. On the basis of the residual amount of data stored in the buffer 203 that is reported from the client 200-*i*, the CPU 101 of the server 100 controls the transmission rate of the tune data being sent to the client 200-*i*.

In this embodiment, a feedback control is performed in such a manner that the transmission rate of the tune data is decreased if the residual amount of data stored in the buffer 203 exceeds a prescribed value and it is increased if the residual amount of data is smaller than the prescribed value. By virtue of this feedback control, the residual amount of data stored in the buffer 203 is kept within a prescribed range. Therefore, even if the data transmission between the server 100 and the client 200-*i* is stopped instantaneously, part of the tune data remaining in the buffer 203 is supplied to the decoder 204 during that period and the music is reproduced without interruption.

The tune data delivery operation that is performed on the single client 200-*i* has been described above. In this embodiment, the clients 200-*k* (k=1 to N) can independently request the server 100 to deliver tune data. During full operation of the system, the server 100 can simultaneously deliver tune data to all of the N clients 200-*k* (k=1 to N) using all of the audio transmission processing sections 110-*k* (k=1 to N) and all of the usable bandwidth of the network.

In this embodiment, a user in the room where the server 100 is installed can use the interphone function to transmit his or her voice to a desired one or ones of the clients 200-*k* (k=1 to N). To do so, the user sends, to the server 100, an instruction to start the interphone function and information for designating one or plural clients 200-*k* as destinations of his or her voice by manipulating a manipulation unit such as a remote controller. The CPU 101 of the server 100 sends, via the network interface 104, a notice of a start of the interphone function to part of the clients 200-*k* that have been designated as destinations and are not reproducing music. The CPU 201 of each of the clients that have received the notice starts controlling the 203, the decoder 204, and the audio output section 205 that are to operate to output, as sound, data that will be received from the server 100 via the network interface 202. The notice of a start of the interphone function need not be sent to the clients that are reproducing music because their CPUs 201 have already started this control.

Then, the CPU 101 of the server 100 performs the following control.

<a. Control on a Client (Assumed to be a Client 200-*a*) that is Selected as a Destination of a Voice Detected by the Microphone 150 and is Reproducing Music>

The CPU 101 performs the following control on the audio transmission processing section 110-*a* which is processing tune data for the client 200-*a* of this kind. First, the CPU 101 sends the volume 112 a volume control signal VCON for lowering the volume of musical data to be output to the mixer 113. The CPU 101 also sends the mixer 113 a command to mix the musical data that is output from the volume 112 with audio data that is output from the A/D converter 103.

As a result of the above control, the audio data that is output from the A/D converter 103 is mixed with the volume-lowered musical data by the mixer 113. Resulting sound data is compression-coded by the encoder 114 and sent to the client 200-*a*. Therefore, volume-lowered music and a voice of the user who is in the room where the server 100 is installed are output from the audio output section 205 in the client 200-*a*.

In the client 200-*a*, the sound data received from the server 100 is supplied to the decoder 204 via the buffer 203. Therefore, the delay time from the acquisition of a voice by the microphone 150 of the server 100 to its output from the audio output section 205 is increased by a delay time of the buffer 203. However, this delay does not raise a problem because the interphone conversation of this embodiment is unidirectional (from the server 100 to a client 200-*k*). Therefore, the capacity and the average delay time of the buffer 203 can be made sufficiently high or long to prevent an instantaneous interruption of music reproduction.

<b. Control on a Client (Assumed to be a Client 200-*b*) that is not Selected as a Destination of a Voice Detected by the Microphone 150 and is Reproducing Music>

The CPU 101 causes the audio transmission processing section 110-*b* which is processing tune data for the client 200-*b* of this kind to continue the current processing. More specifically, the volume 112 of the audio transmission processing section 110-*b* supplies musical data received from the decoder 111 to the mixer 113 at an ordinary volume. The mixer 113 outputs the musical data received from the decoder 111 to the encoder 114 as it is, that is, without adding output data of the A/D converter 103 to the musical data. Therefore, the same music reproduction as before is continued in the client 200-*b*.

<c. Control on a Client (Assumed to be a Client 200-*c*) that is Selected as a Destination of a Voice Detected by the Microphone 150 and is not Reproducing Music>

The CPU 101 assigns an unused audio transmission processing section 110-*c* to the client 200-*c* of this kind and causes the audio transmission processing section 110-*c* to performs the following operation. First the decoder 111 and the volume 112 are not caused to operate because it is not necessary to deliver tune data to the client 200-*c*. The mixer 113 outputs audio data received from the A/D converter 103 to the encoder 114 as it is, and the encoder 114 compression-coding the received audio data and outputs resulting data. The network interface 104 transmits the received data to the corresponding client 200-*c*. The CPU 201 of the client 200-*c* has already started controlling the buffer 203, the decoder 204, and the audio output section 205 that are to output, as sound, data received from the server 100, in response to the above-mentioned notice of a start of the interphone function. Therefore, in the client 200-*c*, the same data as the audio data received from the A/D converter 103 is decoded by the decoder 204 and a voice of the user who is in the room where the server 100 is installed is output from the audio output section 205.

<d. Control on a Client (Assumed to be a Client 200-*c*) that is not Selected as a Destination of a Voice Detected by the Microphone 150 and is not Reproducing Music>

The CPU 101 does nothing for the client 200-*c* of this kind.

The operation that is performed in response to issuance of the instruction to start the interphone function has been described above.

To finish the interphone function, the user who is in the room where the server 100 is installed gives the server 100 an instruction to finish the interphone function by manipulating the manipulation unit such as a remote controller. The CPU 101 of the server 100 sends a notice of an end of the interphone function to each client to which the notice of a start of the interphone function was sent, that is, the client 200-*c* that had been selected as a destination of a voice detected by the microphone 150 and was not reproducing music when the interphone function was started. When receiving this notice, the CPU 201 of the client 200-*c* finishes controlling the buffer 203, the decoder 204, and the audio output section 205 that are to operate to output, as sound, data received from the server 100 via the network interface 202. The CPU 101 of the server 100 also performs the following control. First, for the audio transmission processing section 110-*a* that has processed the tune data for the client 200-*a*, the CPU 101 sends the volume 112 a volume control signal VCON for returning the volume of the musical data to be output to the mixer 113 to the original value and sends the mixer 113 a command to output, as it is, the musical data that is output from the volume 112, that is, without mixing it with the data that is output from the A/D converter 103. The CPU 101 sends no command to the audio transmission processing section 110-*b* that has processed the tune data for the client 200-*b*, and thereby causes the audio transmission processing section 110-*b* to continue the current processing. The CPU 201 stops the operation of the audio transmission processing section 110-*c* that has performed the processing for the above-mentioned client 200-*c*, and thereby returns the audio transmission processing section 110-*c* to an unused state. As a result of the above control, the operation states of the server 100 and each of the clients 200-*k* (k=1 to N) return to the same states as they were before the start of the interphone function.

Figure 2:
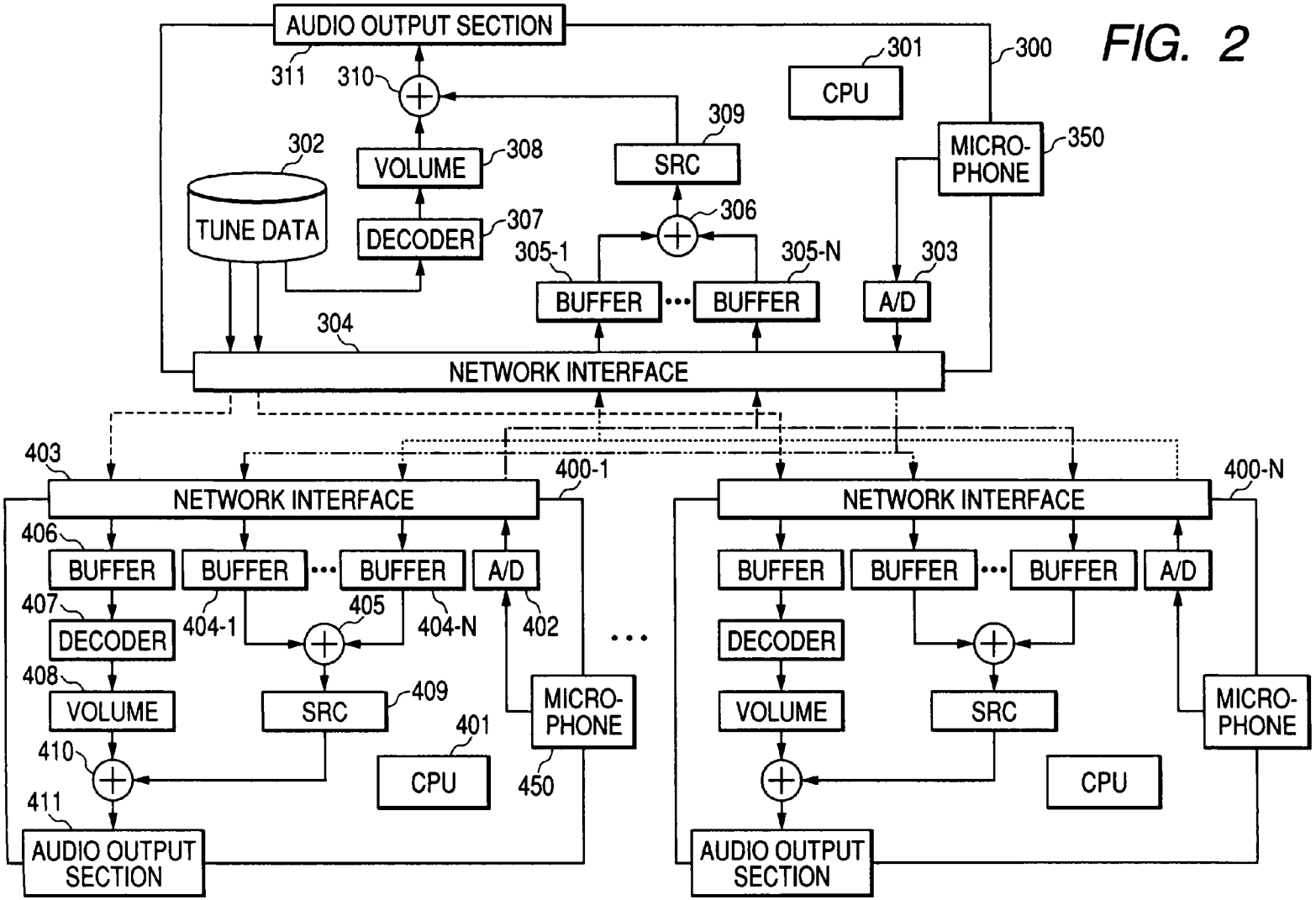
FIG. 2 is a block diagram showing the configuration of a music delivering system according to a second embodiment of the invention.

FIG. 2 is a block diagram showing the configuration of a music delivering system according to a second embodiment of the invention. As in the case of the first embodiment, this music delivering system is composed of a server 300 and N clients 400-*k* (k=1 to N) which are connected to each other via a network.

First, the configuration of the server 300 will be described. A CPU 301, which is a control unit for controlling the individual components of the server 300, performs a control for delivering tune data to the clients 400-*k* (k=1 to N) and a control for realizing an interphone function. A storage device 302 is an HDD, for example, and a database of tune data obtained by compression-coding musical data is stored therein. A microphone 350 is connected to the server 300. An A/D converter 303 converts an analog audio signal that is output from the microphone 350 into digital audio data and outputs the digital audio data. A network interface 304 is an interface through which to perform a data communication with each of the clients 400-*k* (k=1 to N) over the network Buffers 305-*k* (k=1 to N) are first-in first-out buffers which temporarily store audio data received from the clients 400-*k* (k=1 to N) via the network interface 304 and output the audio data at a fixed rate, respectively. A mixer 306 mixes together the audio data that are output from the respective buffers 305-*k* (k32 1 to N) and outputs resulting data.

Under the control of the CPU 301, a decoder 307 decodes tune data that is read from the storage device 302 and outputs resulting musical data. A volume 308 controls the volume of the musical data received from the decoder 307 according to a volume control signal VCON that is supplied from the CPU 301, and outputs resulting musical data. A sampling rate conversion section 309 performs a sampling rate conversion on the audio data that is output from the mixer 306, and outputs audio data having the same sampling rate as the musical data that is output from the decoder 307. A mixer 310 mixes the musical data that is output from the volume 308 with the audio data that is output from the sampling rate conversion section 309, and outputs resulting sound data. An audio output section 311 is composed of a D/A converter (not shown) for converting the sound data that is output from the mixer 310 into analog audio signals and speakers (not shown) for outputting the analog audio signals as sound.

Next, the configuration of each of the clients 400-*k* (k=1 to N) will be described. A microphone 450 is connected to the client 400-*k*. An A/D converter 402 converts an analog audio signal that is output from the microphone 450 into digital audio data and outputs the digital audio data. A CPU 401, which is a control unit for controlling the individual components of the client 400-*k*, performs a control for receiving musical data from the server 300 and reproduces it according to a user's instruction that is given through a remote controller (not shown) or the like. Further, the CPU 401 performs a control for realizing the interphone function of receiving audio data from the server 300 and/or another or other clients and reproducing the received audio data as well as sending audio data acquired by the microphone 450 to the server 300 and/or the other client(s). A network interface 403 is an interface through which to perform a data communication with the server 300 and/or another or other clients over the network. Buffers 404*k* (k=1 to N) are first-in first-out buffers which temporarily store audio data received from the server 300 and the other clients via the network interface 403 and output the audio data at a fixed rate, respectively. A mixer 405 mixes together the audio data that are output from the respective buffers 404-*k* (k=1 to N) and outputs resulting data.

A buffer 406 is a first-in-first-out buffer which sequentially stores tune data received from the server 300 via the network interface 403 and supplies the stored tune data to a decoder 407 in order of storing under the control of the CPU 401. Under the control of the CPU 401, a decoder 407 decodes tune data that is output from the buffer 406 into musical data that is the same as before being compression-coded. A volume 408 controls the volume of the musical data received from the decoder 407 according to a volume control signal VCON that is supplied from the CPU 401, and outputs resulting musical data. A sampling rate conversion section 409 performs a sampling rate conversion on the audio data that is output from the mixer 405, and outputs audio data having the same sampling rate as the musical data that is output from the decoder 407. A mixer 410 mixes the musical data that is output from the volume 408 with the audio data that is output from the sampling rate conversion section 409, and outputs resulting sound data. An audio output section 411 is composed of a D/A converter (not shown) for converting the sound data that is output from the mixer 410 into analog audio signals and speakers (not shown) for outputting the analog audio signals as sound.

In this embodiment, a bidirectional interphone conversation is held and a voice of a user who is in an interphone conversation is required to reach the other user in real time. Therefore, the capacity and the delay time of the buffers 305-*k* (k=1 to N) and the buffers 404-*k* (k=1 to N) are set to minimum necessary values so as to satisfy this requirement of realtimeness.

Next, the operation of this embodiment will be described. In this embodiment, tune data that is read from the storage device 302 is sent to a client as a request source of the tune data as it is. The tune data is decoded into musical data by the decoder 407 of the client and reproduced as music by the audio output section 411. In this embodiment, not only each client but also the server 300 has a data reproducing unit for reproducing tune data (the decoder 307 and the audio output section 311 in the case of the server 300). Therefore, a user in the room where the server 300 is installed can request the server 300 to reproduce tune data by manipulating a remote controller or the like. In the server 300, the tune data requested by the user is read from the storage device 302 and decoded into musical data by the decoder 307. The musical data passes through the volume 308 and the mixer 310 and is reproduced by the audio output section 311 as music. The operation of delivering tune data is basically the same as described in the first embodiment except for the above point.

In this embodiment, by manipulating the server 300 or one of the clients 400-*k* (k=1 to N), a user can hold an interphone conversation with another or other users of another or other clients and/or the server 300. The operation for such an interphone conversation will be described below.

A user who wants to hold an Interphone conversation with another or other users sends, to the server 300 or one or plural ones of the clients 400-*k* (k=1 to N), a command for a start of the interphone function and information for designating the server 300 and/or the client(s) (i e., the apparatus(es) associated with the user(s) to hold an interphone conversation with) by manipulating a remote controller or the like. Either one apparatus or plural apparatuses may be selected as an apparatus(es) associated with the user(s) to hold an interphone conversation with. In the following description, the server 300 and the clients will be generically called "terminals." And the server 300 or a client that has been given a command for a start of the interphone function will be referred to as "parent terminal" and the server 300 and/or a client(s) that has been designated as an apparatus(es) associated with the user(s) to hold an interphone conversation with will be referred to as "child terminal(s)."

The CPU 301 or 401 of a parent terminal sends, to child terminals, via the network interface 304 or 403, a joining request and a joining terminal list that specifies the parent terminal and child terminals that are supposed to join an interphone conversation. The CPUs 301 or 401 of each of the parent terminal that has sent the joining request and the child terminals that have received the joining request performs the following processing to enable reception and reproduction of audio data coming from the terminals on the joining terminal list. First, The CPU 301 or 401 causes the network interface 304 or 403 to establish links for bidirectional communications with the other terminals on the joining terminal list. Then, the CPU 301 or 401 starts operation of part of the buffers 305-*k* (k=1 to N) or 404-*k* (k=1 to N) that are to temporarily store audio data coming from the other terminals on the joining terminal list, and also starts a mixing operation of the mixer 306 or 405, operation of the sampling rate conversion section 309 or 409, and a mixing operation of the mixer 310 or 410. Further, the CPU 301 or 401 starts an operation of transmitting, to all of the other terminals on the joining terminal list, via the network interface 304 or 403, audio data that is output from the A/D converter 303 or 402. Still further, if the decoder 307 or 407 of the terminal concerned is decoding tune data, the CPU 301 or 401 supplies the volume 308 or 408 with a volume control signal VCON to the effect that musical data obtained by the decoding should be output at a lowered volume level.

As a result of the above control, in each joining terminal, audio data coming from the other joining terminals are received by the network interface 304 or 403 and temporarily stored in the part of the buffers 305-*k* (k=1 to N) or 404-*k* (k=1 to N) that correspond to the other terminals on the joining terminal list. The temporarily stored audio data sent from the other terminals are subjected to mixing by the mixer 306 or 405, and resulting audio data is processed by the sampling rate conversion section 309 or 409, passes through the mixer 310 or 410, and is output from the audio output section 311 or 411 as sound. In each joining terminal in which the decoder 307 or 407 is decoding tune data, musical data that is output from the decoder 307 or 407 is lowered in volume in passing through the volume 308 or 408 and is mixed with the audio data coming from the other joining terminals by the mixer 310 or 410. Therefore, sound obtained by mixing volume-lowered music and voices of the other joining terminals is output from the audio output section 311 or 411.

The reason why the volume of music reproduced by each joining terminal is to make voices of the users of the other joining terminals easy to hear. To what extent the volume of music should be lowered to make voices easy to hear depends on the individual (i.e., user). Therefore, it is preferable that each terminal be provided with a manipulation unit for setting the extent of lowering of the volume of music when the interphone function is used.

If the user gives an instruction for an end of the interphone function to the parent terminal by manipulating a remote controller or the like, the CPU 301 or 401 of the parent terminal sends a command for an end of the interphone function to the child terminals. When receiving this command, the CPU 301 or 401 of each child terminal returns the internal states of the terminal to the same states as before reception of the command for the start of the interphone function.

Embodiment 3

In the first and second embodiments, to what extent the volume of reproduced music should be lowered during use of the interphone function is set by the user's manipulating the manipulation unit. In contrast, in this embodiment and a fourth embodiment (described later), during use of the interphone function, the volume of musical data is optimized automatically on the basis of average volume levels of musical data and audio data. This embodiment is such that this automatic volume optimization technique is applied to the above-described first embodiment.

In this embodiment, average volume levels of musical data are determined in advance for respective tunes and stored in the storage device 102 of the server 100 so as to be associated with the respective tunes. When receiving a tune data delivery request from a client, the CPU 101 of the server 100 reads the average volume level of the musical data of the tune from the storage device 102 and stores it. Therefore, the CPU 101 has a good. grip of average volume levels of musical data of tunes that are being reproduced by clients, respectively.

When the interphone function has been started, the CPU 101 of the server 100 performs the following processing for every client (assumed to be a client 200-*a*) that is reproducing music and is selected as a destination of audio data that is output from the microphone 150.

First, the CPU 101 measures (calculates) an average volume level of an audio signal or data acquired by the microphone 150 in each prescribed period. Each average volume level may be calculated from either an analog audio signal that is output from the microphone 150 or audio data that is output from the A/D converter 103. An average volume level becomes inaccurate if it is calculated on the basis of volume levels in a period when the user utters nothing Therefore, each average volume level may be calculated only in a period when the volume exceeds a prescribed threshold value th. After obtaining a voice average volume level, the CPU 101 calculates a volume value according to the following equation using the acquired voice average volume level and the stored average volume level of musical data of a tune being reproduced by the client 200-*a:*

$$\text{(Volume value) (dB)} = 20\cdot\log_{10}\{\text{(voice average volume level)/(stored average volume level of musical data)}\} - A \quad \ldots (1)$$

The constant A indicates a dB value by which the average volume level of the musical data should be set lower than the voice average volume level. The constant A is given to the CPU 101 by a user by manipulating the manipulation unit. To prevent clipping, the maximum value of the volume value calculated according to Equation (1) is set to 0 dB.

The calculation of a voice average volume level requires a volume measurement over the prescribed time and hence no voice average volume level exists at an initial stage of execution of the interphone function. Therefore, at the initial stage, a voice average volume level that was calculated last in the preceding execution of the interphone function is substituted into Equation (1).

The CPU 101 sends a volume control signal VCON for setting the volume value obtained according to Equation (1) to the volume 112 of the audio transmission processing section 110-*a* that is processing the tune data for the client 200-*a*. The CPU 101 also sends the mixer 113 a command to mix the musical data with the audio data.

A new voice average volume value is thereafter continued to be obtained every time the prescribed time elapses. Every time a new voice average volume value is obtained, the CPU 101 calculates a volume value according to Equation (1) and sends a volume control signal VCON for setting the calculated volume value to the volume 112 of the audio transmission processing section 110-*a* that is processing the tune data for the client 200-*a*.

As described above, according to this embodiment, during use of the interphone function, a manipulation of setting a proper volume value in the volume 112 in accordance with an average volume level of a voice of a user of the server 100 to make the user's voice easy to hear is performed automatically.

Embodiment 4

This embodiment is such that the technique of automatically optimizing the volume of musical data during use of the interphone function is applied to the above-described second embodiment. In the third embodiment, audio data of a user of the server 100 is mixed with musical data and sent to clients and hence the volume control on musical data for each client with which to hold an interphone conversation is performed by the server 100. In contrast, in the second embodiment that is the base of this embodiment, a voice to be transmitted to other terminals can be acquired by the microphone 350 or 450 in each terminal such as the server 200 or a client and an interphone conversation is held bidirectionally. Therefore, the following control is performed in this embodiment.

First, in this embodiment, as in the case of the third embodiment, the CPU 301 of the server 300 has a good grip of average volume levels of musical data of tunes that are being reproduced by clients, respectively. As described in the second embodiment, to start an interphone conversation, the CPU 301 or 401 of a parent terminal that is a source of requests to join the interphone conversation sends, to child terminals that are requested to join the interphone conversation, via the network interface 304 or 403, a joining request and a joining terminal list that specifies the parent terminal and child terminals that are supposed to join the interphone conversation.

At this stage, each of the terminals, excluding the server 300, that are supposed to join the interphone conversation inquires of the server 300 the average volume level of a tune being reproduced in the terminal itself. The system may be configured in such a manner that in starting to deliver musical data the server 300 communicates the average volume level of the musical data to a destination client. In this case, it is not necessary for each terminal to inquire the average volume level.

Then, the CPU 301 or 401 of each of the terminals that are holding the interphone conversation starts to measure an average volume level of an audio signal or data acquired by the microphone 350 or 450 of the terminal itself. In this embodiment, since the interphone conversation is bidirectional, voices are detected intermittently by the microphone 350 or 450 of each terminal. Therefore, to perform measurements accurately, it is preferable to calculate each average volume level only in a period when the volume exceeds a prescribed threshold value th.

A voice average volume level is obtained by measuring the volume of a voice for a prescribed time, and a new voice average volume level is obtained every time the prescribed time elapses. In this embodiment, every time a new voice average volume level is obtained, the CPU 301 or 401 of each of the terminals that are holding the interphone conversation communicates it to the other terminals on the joining terminal list.

The calculation of a voice average volume level requires a volume measurement over the prescribed time and hence no voice average volume level to be communicated to the other terminals exists at an initial stage of the interphone conversation. Therefore, at the initial stage, each terminal communicates, to the other terminals, a voice average volume level that was calculated last in the preceding interphone conversation.

Each of the terminals that are holding the interphone conversation receives, from each of the other joining terminals, every predetermined time, a notice of an average volume level of a voice of a user of the terminal. When receiving a notice of a voice average volume level for the first time from a certain joining terminal, the CPU 301 or 401 of each of the joining terminals calculates a volume value according to the above-mentioned Equation (1) using the received voice average volume level and the average volume level of the musical data received from the server 300.

The CPU 301 or 401 sends a volume control signal VCON for setting the calculated volume value to the volume 308 or 408 and also sends the mixer 310 or 410 a command to mix the musical data with the audio data.

Then, every time a voice average volume level has been received from one or more other joining terminals, the CPU 301 or 401 calculates a minimum value (at the time of the calculation) of the received voice average volume levels and calculates a volume value according to Equation (2) using the calculated minimum value and the average volume level of the musical data received from the server 300:

$$(\text{Volume value})\ (\text{dB}) = 20 \cdot \log_{10}\{(\text{minimum value of voice average volume levels})/(\text{average volume level of musical data})\} - A \quad \ldots (2)$$

As in the case of the third embodiment, the maximum volume value is set to 0 dB.

The CPU 301 or 401 sends a volume control signal VCON for setting the calculated volume value to the volume 308 or 408.

This embodiment provides the same advantage as the third embodiment does. Further, in this embodiment, in each joining terminal of an interphone communication, a volume control is performed on musical data on the basis of a minimum value of voice average volume levels received from the other joining terminals. Therefore, the volume of music being reproduced can be lowered so as to be suitable for a user uttering a lowest-level voice among the other users involved in the interphone conversation. As such, this embodiment enables an interphone conversation in which each user can hear voices of the other users more easily.

Other Embodiments

Although the several embodiments of the invention have been described above, the application range of the invention is not limited to those. For example, although the above embodiments are such that the invention is applied to the music delivering system in which compression-coded musical data is transmitted from the server to a client, the invention may be applied to a music delivering system in which sampling data of music that is not compression-coded is transmitted from a server to a client. In this case, the decoders 111 and 204 and the encoders 114 can be omitted in the configuration of FIG. 1 and the decoders 307 and 407 can be omitted in the configuration of FIG. 2. Another configuration is possible in which compression-coded musical data and non-compression-coded musical data are stored in a tune data database in mixed form. Musical data of the former type is decoded by each decoder when delivered, and musical data of the latter type bypasses each decoder when delivered.

What is claimed is:

1. A music delivering apparatus, comprising:

a storing unit that stores musical data;

a sound collecting unit that collects a voice from outside to output audio data for an interphone conversation;

a reading unit that reads the musical data from the storing unit;

a mixer that mixes the audio data with the musical data read out by the reading unit to output sound data;

a transmitting unit that transmits the sound data to a client;

a volume control unit that lowers volume of the musical data that is read out by the reading unit and supplied to the mixer while the audio data is supplied to the mixer;

a volume level storage unit that stores an average volume level of the musical data for each tune; and a detecting unit that detects an average volume level of the audio data acquired by the sound collecting unit, wherein the volume control unit lowers the volume of the musical data based on the detected average volume level of the audio data and the average volume level of the musical data that is supplied to the mixer.

2. A music reproducing apparatus, comprising:

a communication unit that receives audio data for an interphone conversation;

a musical data acquiring unit that acquires musical data;

a mixer that mixes the audio data with the musical data to output sound data;

an audio output unit that outputs sound corresponding to the sound data;

a volume control unit that lowers volume of the musical data that is supplied to the mixer while the audio data is supplied to the mixer;

a detecting unit that detects an average volume level of the audio data acquired by a sound collecting unit; and a transmitting unit that receives an average volume level of the musical data acquired by the musical data acquiring unit, wherein the volume control unit lowers the volume of the musical data based on the detected average volume level of the audio data and the received average volume level of the musical data.

3. A method of delivering music, comprising:

collecting a voice from outside to output audio data for an interphone conversation;

reading musical data from a storing unit;

mixing the audio data with the musical data to output sound data;

transmitting the sound data to a client;

lowering volume of the musical data that is read out from the storing unit while the sound data including the audio data is transmitted to the client;

detecting an average volume level of the audio data; and reading an average volume level of the musical data for each tune from a volume level storage unit, wherein in the lowering process, the volume of the musical data is lowered based on the detected average volume level of the audio data and the average volume level of the musical data.

4. A method of reproducing a music, comprising:

receiving audio data through a communication unit;

acquiring musical data;

mixing the audio data with the musical data to output sound data;

outputting sound corresponding to the sound data;

lowering volume of the musical data while sound corresponding to the audio data is output;

detecting an average volume level of the audio data; and receiving an average volume level of the musical data for each tune from a volume level storage unit, wherein in the lowering process, the volume of the musical data is lowered based on the detected average volume level of the audio data and the received average volume level of the musical data.

* * * * *